United States Patent [19]

Broch

[11] 3,935,691

[45] Feb. 3, 1976

[54] MACHINE FOR PACKAGING BOX-SHAPED ARTICLES IN BAGS

[75] Inventor: Jan Broch, Rodovre, Denmark

[73] Assignee: Schulstad Brod A/S, Glostrup, Denmark

[22] Filed: Nov. 8, 1974

[21] Appl. No.: 522,283

[30] Foreign Application Priority Data

Nov. 8, 1973 Denmark ..... 6039/73

[52] U.S. Cl. ..... 53/59 R; 53/189; 53/385

[51] Int. Cl.[2] ..... B65B 57/10; B65B 43/36

[58] Field of Search ..... 53/189, 385, 59 R

[56] References Cited

UNITED STATES PATENTS 2,850,855 9/1958 Offutt ..... 53/384 X 3,579,951 5/1971 Lowery ..... 53/189 X

*Primary Examiner*—Travis S. McGehee

*Attorney, Agent, or Firm*—Mason, Fenwick & Lawrence

[57] ABSTRACT

A machine for packaging loaves in bags having a reciprocating bag magazine in which the at any time topmost bag is ready for receiving a loaf. Each loaf is pushed into a bag with such speed that when hitting the bag bottom the loaf will take the bag along away from the magazine. After having left the magazine the bagged loaf slides onto a discharge conveyor. Limit switches control the moment of bagging the following loaf.

8 Claims, 2 Drawing Figures

MACHINE FOR PACKAGING BOX-SHAPED ARTICLES IN BAGS

Figure 1:
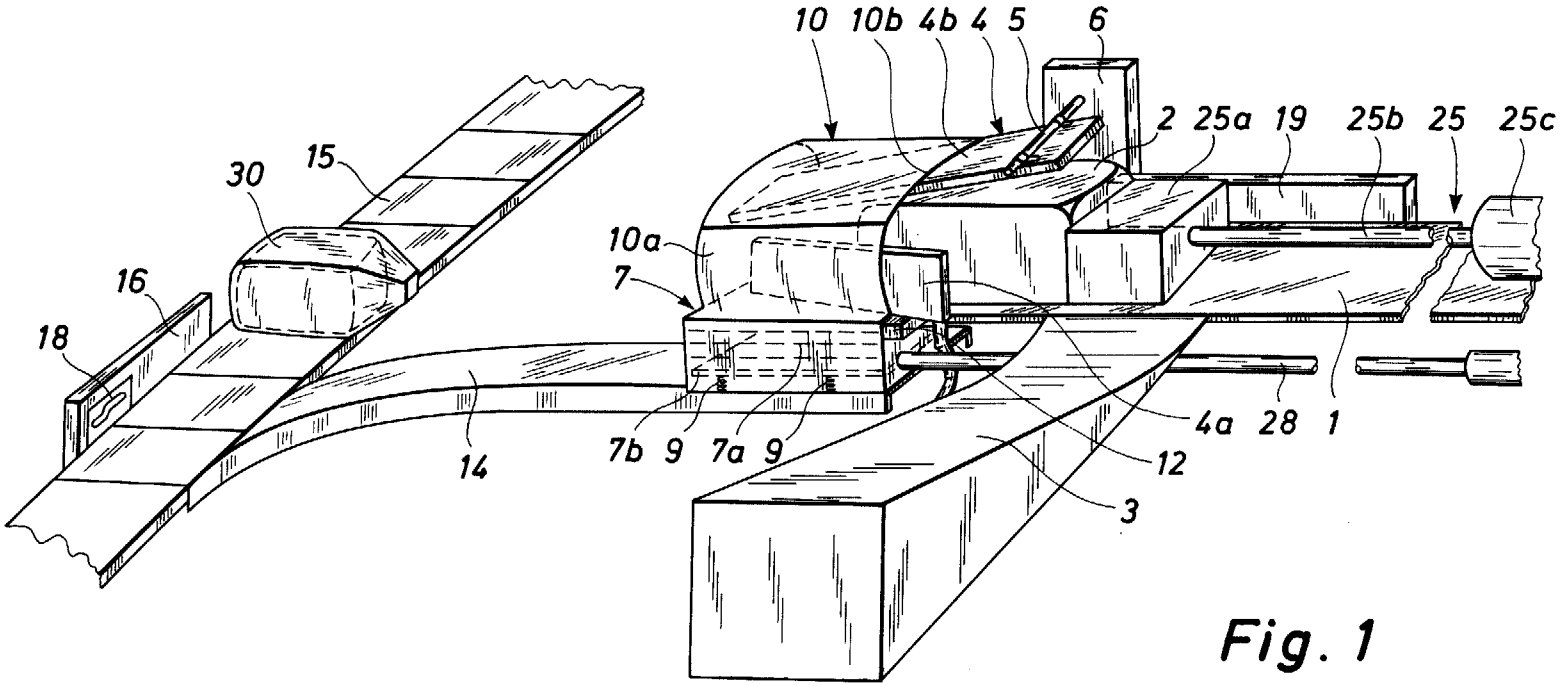

The invention relates to a machine for packaging in bags box-shaped articles such as loaves of bread, wherein the articles having a suitable strength and weight are fed to a bag magazine, said machine comprising a feed means for feeding the articles to the magazine as well as a guide finger means for guiding the article and the bag relative to each other during the insertion of the article into the bag.

A machine for bagging loaves of bread is known wherein a movable scoop means, which can be extended and retracted transverse to a loaf conveyor; is periodically inserted into the at any time topmost bag of a bag magazine and during its return movement pulls the bag over a stationary loaf of bread, the latter being delivered into the U-shaped scoop by the loaf conveyor. Just before the termination of the return movement of the scoop when the bag has been pulled over loaf and scoop a blockade means is brought to abut on the loaf so as to ensure that the scoop at the termination of its return movement releases the bag and permits said bag and the loaf therein to fall down onto an auxiliary conveyor. This machine is not so reliable as is desirable for packaging heavy articles as wrong packing or imperfect articles may cause damage to the machine.

The object of the invention is to provide a machine of the type mentioned above which is simpler and more reliable than the known machine.

The machine according to the invention is characterized in the bag magazine being adapted to be reciprocated between a first end position far from the guide finger means, in which position the topmost bag of the magazine is inflated, and a second end position close to the guide finger means in which the inflated bag is pushed over part of the guide finger means, and the feed means being adapted to feed one article at a time into the bag through the beak-like means when the magazine is in its close end position and at the same time an article already bagged has reached a discharge conveyor, the feeding being effected at such a speed that after having hit the bottom of the bag the article pulls the bag along away from the magazine. As a result the individual article will at any time be centered correctly in its bag as the article pulls the bag along when hitting the bottom of the bag. When the bag has been filled a new bag can be made ready quickly — i.e., inflated — by the magazine reciprocating and the orifice of the inflated bag being pushed over the guide finger means. The feed means will not feed an article through the guide finger means into the bag until each of said article and the article bagged shortly before has actuated a limit switch. When the bagged article has left the magazine it slides down a chute to the discharge conveyor. The machine comprises a rather small amount of parts and is easy to operate for unskilled labour.

According to the invention the reciprocation of the bag magazine may be effected by hydraulic or pneumatic means in the form of a cylinder-piston arrangement which does not initiate the movement of the magazine towards the far end position until the feed means is in its foremost position. Consequently, a high degree of reliability is obtained since a bagged article will never collide with the bag magazine.

Furthermore, according to the invention the feed means may be formed as a hydraulic or pneumatic cylinder-piston arrangement which can be started only when an article has actuated a limit switch in front of the guide finger means and an already bagged article has actuated a limit switch at the discharge conveyor. This eliminates the possibility of the chute being blocked between the guide finger means and the discharge conveyor.

Further according to the invention the bag magazine may be provided with an air nozzle for inflating the at any time topmost bag of the magazine. As a result a very reliable opening of the bags is obtained.

Finally, according to the invention the guide finger means may comprise a stationary horizontal cantilever guide finger portion and an inclined pivotally mounted guide finger portion widening the space between the portions and thereby the orifice of the bag as an article is fed through the space between the guide finger means. As a result it is possible to fit the bag very tightly over the article.

The invention will be described below with reference to the drawings, in which

Figure 2:
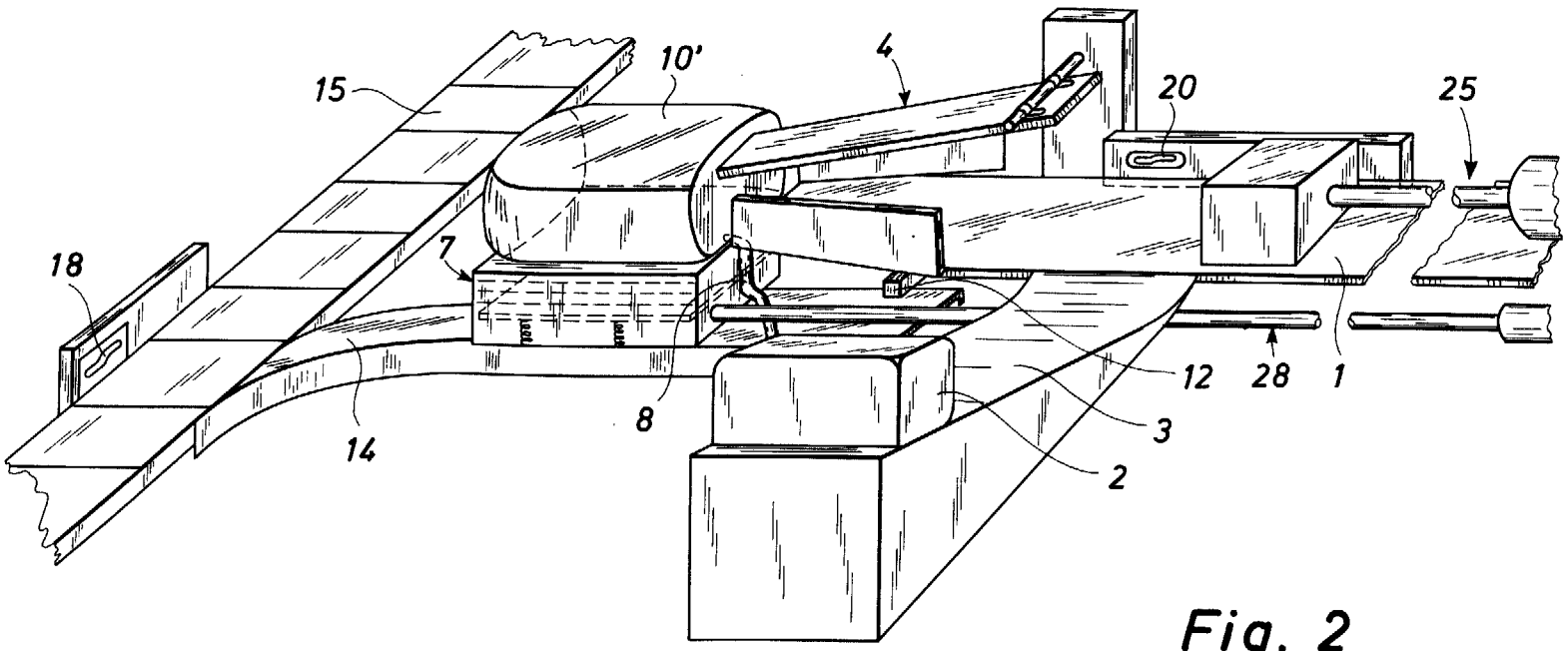

FIG. 1 is a perspective diagonal side view of an embodiment of the machine according to the invention, the bag magazine being in its end position close to the guide finger means, and a bag being partly pushed over said guide finger means, and FIG. 2 a perspective diagonal side view of same embodiment, the bag magazine being in its end position far from the guide finger means.

The machine shown in FIG. 1 comprises a feed path 1 for box-shaped articles such as loaves of bread. The articles are delivered to the feed path via an inclined feed chute 3. At the end of the feed path 1 is a guide finger means 4 comprising a stationary substantially horizontal guide finger portion **4*a* and an inclined guide finger portion 4*b* pivotally mounted on an upright 6 (the reference numeral of the pivot being 5). In connection with the guide finger means a horizontally movable bag magazine 7 is mounted comprising a box as well as a stack of bags 7*a* supported by a bottom plate 7*b* loaded by springs 9. The parts 7*a*, 7*b*, and 9 are indicated by dotted lines as they are inside the box. At the side of the magazine facing towards the guide finger means an air pipe with a nozzle 8 is mounted — cf. FIG. 2. Said nozzle 8 ensures that the at any time topmost bag 10 of the stack is inflated. The magazine 7 can be reciprocated between a first end position far from the guide finger means (corresponding to the position shown in FIG. 2) and a second end position close to the beak-like means, i.e., substantially below said guide finger means (corresponding to the position shown in FIG. 1). In the latter position the magazine abuts on a stop 12. In the end position of the bag magazine 7 as shown in FIG. 1 the topmost bag 10 partly covers the guide finger means 4. To the left of the magazine 7 is a curved feed path 14 guiding the bagged articles to the discharge conveyor 15. A stop plate 16 with a limit switch 18 is provided at the termination of the feed path 14**.

A second limit switch 20 is mounted on a side plate 19 — cf. FIG. 2 — opposite the place where the feed chute 3 is connected to the feed path 1. The switch 18 can only be actuated by the bagged articles, whereas the limit switch 20 is actuated by unbagged articles only. The limit switches form part of an electric circuit which can initiate the feed means 25 comprising a piston **25*a*, a piston rod 25***b*, and a hydraulic or pneumatic cylinder 25*c*. The feed means 25 serves the purpose of successively feeding articles into the bags of the bag magazine.

Below the feed path 1 a feed mechanism is provided in the form of a second cylinder-piston arrangement reciprocating the bag magazine between the end positions shown in FIGS. 1 and 2 respectively. The cylinder-piston arrangement 28 takes the bag magazine 7 to the left and back again each time an article has been bagged and bag plus article have left the magazine.

Between the limit switch 18 and the lower end of the curved feed path 14 a transfer deck may be provided, where the bagged article 30 may be deposited for a short period of time until a separate pneumatic or hydraulic press member not shown will press the bagged article 30 onto the discharge conveyor 15.

The machine operates as follows:

When an article has slid down the curved feed path 3 to the feed path 1 and has actuated the limit switch 20, and furthermore an already bagged article has actuated the limit switch 18 the feed means 25 is initiated so as to press the article through the guide finger means 4, the pivotally mounted portion of the latter at the same time being turned upwards. As shown in FIG. 1 the topmost bag 10 is pushed over the guide finger means 4 and is then filled by the article 2. The piston 25a of the feed means travels at a high speed, and therefore the article 2 will hit the bottom 10a of the bag 10 at a high speed, thereby tearing the bag 10 along to the left away from the bag magazine 7. As the bag is removed from the magazine it is separated from a magazine clip not shown. As is seen the guide finger means serves as an additional guarantee that the article 2 will not collide with the edges 10*b* of the bag 10 at the orifice of the bag as it is fed into the bag. After the bag 10 and the article 2 therein have left the bag magazine the feed mechanism 28 is started taking the magazine 7 from the position shown in FIG. 1 to the one shown in FIG. 2, in which the bag 10 which is now the topmost one is inflated by the nozzle 8. Immediately thereafter the magazine is taken back to the position of FIG. 1, and during that operation the orifice of the new bag is pushed some distance over the guide finger means 4 so that a new article can be bagged.

The operation of the machine according to the invention involves a low rate of bag waste only, viz. about ½%.

The discharge conveyor 15 delivers the bagged articles to a station for providing the bags with bag clips, said station not being shown.

Many changes and modifications of the invention can be made without departing from its spirit.

The articles to be bagged must be of suitable strength and weight so that they will not be damaged by falling from the magazine 7 onto the curved feed path 14. As mentioned above the machine has proved to be particularly suitable for bagging loaves of bread, especially loaves of rye bread.

I claim:

1. A machine for packaging box-shaped articles such as loaves of bread in bags, said machine including a bag magazine containing a stack of bags, article feed means including pusher means mounted for reciprocation between a retracted position and an extended position for feeding the articles toward the bag magazine, spaced guide finger means for guiding the articles and bags relative to each other during insertion of an article into the bag, a discharge conveyor for removing the bagged articles, means for reciprocating said bag magazine between a first position spaced from the guide finger means and a second position adjacent the guide finger means in which the guide finger means partially overlie the magazine, means for inflating the topmost bag in said magazine when said magazine is in said first position so that movement of said magazine to said second position causes the uppermost inflated bag of said magazine to receive the ends of said guide finger means on its interior, said feed means including power means for operating said pusher for feeding one article at a time into the uppermost inflated bag by moving the article through the space between said spaced guide finger means into the uppermost bag when the bag magazine is in its second position following arrival of the next previously bagged article at said discharge conveyor and wherein said power means for operating said pusher means operates the pusher at a speed to move the article at a sufficient speed to cause forceful engagement of the article with the bottom of the bag to move the bag from the top of the bag magazine to the discharge conveyor.

2. The invention of claim 1 wherein said means for reciprocating said bag magazine includes a piston and cylinder means operable for initiating movement of the bag magazine toward its first position when the pusher means is in its retracted position.

3. The invention of claim 2 wherein said article feed means includes a cylinder and piston means, limit switch means for detecting an article in alignment with the guide finger means in position to be fed into the uppermost inflated bag on the magazine by said pusher means, a second limit switch adjacent the discharge conveyor for detecting a bagged article wherein said cylinder and piston means for operating said feeding means is operable only upon actuation of said first and second limit switches.

4. The invention of claim 3 wherein said means for inflating the uppermost bag in said bag magazine comprises air nozzle means.

5. The invention of claim 4 wherein said guide finger means comprises elongated fixed cantilever guide fingers and a pivotally mounted guide finger, said guide finger being supported on one end adjacent said pusher means, said guide fingers being canted inwardly toward each other from their ends adjacent the pusher means toward the bag means whereby the ends of said guide finger means entering the bag means are more closely spaced than are the supported ends of said guide finger means.

6. The invention of claim 1 wherein said guide finger means comprises elongated fixed cantilever guide finger means and a pivotally mounted guide finger, said guide fingers being supported on one end adjacent said pusher means, said guide fingers being canted inwardly toward each other from their supported ends adjacent the pusher means toward the bag means whereby the ends of said guide finger means entering the bag means are more closely spaced than are the supported ends of said guide finger means.

7. The invention of claim 6 wherein said means for reciprocating said bag magazine includes a piston and cylinder means operable for initiating movement of the bag magazine in its first position when the pusher means is in its retracted position.

8. The invention of claim 7 wherein said article feed means includes a cylinder and piston means, limit switch means for detecting an article in alignment with the guide finger means in position to be fed into the uppermost inflated bag on the magazine by said pusher means, a second limit switch adjacent the discharge conveyor for detecting a bagged article wherein said cylinder and piston means for operating said feeding means is operable only upon actuation of said first and second limit switches.

* * * * *